US008714300B2

(12) United States Patent
Johansen

(10) Patent No.: US 8,714,300 B2
(45) Date of Patent: May 6, 2014

(54) SILENCER FOR A FIREARM

(71) Applicant: A-Tec Holding AS, Son (NO)

(72) Inventor: Anders Eckhoff Johansen, Son (NO)

(73) Assignee: A-Tec Holdings AS, Son (NO)

( * ) Notice: Subject to any disclaimer, the term of this patent is extended or adjusted under 35 U.S.C. 154(b) by 0 days.

(21) Appl. No.: 13/689,333

(22) Filed: Nov. 29, 2012

(65) Prior Publication Data

US 2013/0133976 A1 May 30, 2013

(30) Foreign Application Priority Data

Nov. 29, 2011 (NO) ..... 20111648

(51) Int. Cl.
*F41A 21/30* (2006.01)

(52) U.S. Cl.
CPC ..... *F41A 21/30* (2013.01)
USPC ..... 181/223; 89/14.4

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 968,583 | A | 8/1910 | Michaud | |
| 1,354,416 | A | 9/1920 | Oliver | |
| 4,893,426 | A | 1/1990 | Bixler | |
| 4,907,488 | A | 3/1990 | Seberger | |
| 5,029,512 | A | 7/1991 | Latka | |
| 5,433,133 | A | 7/1995 | La France | |
| 5,559,302 | A | 9/1996 | Latka | |
| 6,701,820 | B2 * | 3/2004 | Fluhr | 89/14.4 |
| 7,743,693 | B1 * | 6/2010 | Brittingham | 89/14.4 |
| 7,789,009 | B1 * | 9/2010 | Brittingham | 89/14.4 |
| 7,891,282 | B1 * | 2/2011 | DeGroat | 89/14.4 |
| 7,905,170 | B1 * | 3/2011 | Brittingham et al. | 89/14.2 |
| 2011/0203152 | A1 * | 8/2011 | Dueck et al. | 42/90 |

FOREIGN PATENT DOCUMENTS

| | | |
|---|---|---|
| FI | 91918 B | 5/1994 |
| GB | 24766 A | 0/1911 |

OTHER PUBLICATIONS

Norwegian Search Report for Application No. 20111648 dated Jun. 18, 2012 (2 pages).
International Search Report and Written Opinion for International Application No. PCT/EP2012/073733 dated Mar. 21, 2013 (14 pages).

* cited by examiner

*Primary Examiner* — Jeremy Luks
(74) *Attorney, Agent, or Firm* — Osha Liang LLP

(57) ABSTRACT

A silencer for a firearm has a substantially cylindrical external housing with an attachment part, an intermediate part with a number of elements, and an outer muzzle part. The silencer can be releasably connected to an attachment element mounted on the barrel of a firearm. The silencer's attachment part is provided with a number of cut-outs round its circumference. The cut-outs are composed of a first portion extending longitudinally and a second portion extending over the circumference of the attachment part. The two portions are connected by an intermediate portion. In the first portion, at least one of the cut-outs will be provided with at least one bead and at least one slot is provided adjacent to the first portion extending over the circumference of the attachment part.

13 Claims, 5 Drawing Sheets

SILENCER FOR A FIREARM

CROSS-REFERENCE TO RELATED APPLICATIONS

The present application claims priority from Norwegian Patent Application No. 20111648, filed Nov. 29, 2011. The content of the priority application is hereby incorporated by reference in its entirety.

BACKGROUND

1. Field of the Disclosure

One or more embodiments relate to a silencer for a firearm, such as a rifle or a pistol, where the silencer comprises a substantially cylindrical casing and where the silencer is intended to be releasably connected to an attachment element which is mounted on the barrel of the firearm.

One or more embodiments also relate to an attachment element which is intended to be releasably connected to a silencer according to the present invention.

2. Background Art

Silencers are used with high-pressure firearms in particular, since in many situations the report when the weapon is fired will be too loud. By means of its construction the silencer will be able to reduce the report and the recoil when shots are fired, thereby avoiding damage to hearing as well as making the marksman feel safer when firing a shot as the recoil is reduced.

Known silencers are of a tubular design and may employ various principles in order to achieve a reduction of the report. We refer here, for example, to the American U.S. Pat. No. 5,029,512 and U.S. Pat. No. 4,907,488.

In U.S. Pat. No. 5,029,512 the principle is employed of setting exhaust gases following the bullet in a rotating motion, thereby lowering the velocity of the exhaust gases before they leave the silencer. In this case, therefore, a number of elements will be arranged one behind the other internally in the cylindrical casing, where the elements interact in order to set the exhaust gases in rotation internally in the easing.

In U.S. Pat. No. 4,907,488 elements are also employed internally in a casing in order to change the direction of flow of the exhaust gases and thereby achieve a sound suppression.

The above silencers are designed to be able to be releasably connected to the barrel of the firearm. The silencer will then be provided with an internally threaded portion, where this threaded portion may either be arranged in the cylindrical casing or also arranged at an end of the silencer, which end will therefore form the silencer's attachment part. The firearm's barrel will then be provided with a corresponding and externally threaded portion over a part of its length, where this threaded portion may be provided at the end of the barrel or a distance into the barrel. The silencer will then be able to be screwed off and on to the firearm's barrel as required.

By means of the related art, however, there will be a possibility that the silencer may be wrongly screwed on to the barrel of the firearm, whereby threads on the silencer and/or the barrel of the firearm could be destroyed. Furthermore, when handling the firearm under extreme conditions, sand, dirt etc. may infiltrate the threaded portion, with the result that it may be impossible to fit a silencer correctly or properly on to the barrel of the firearm. Finally, a problem could also arise with unscrewing the silencer when it has been mounted on the barrel of the firearm for a lengthy period.

SUMMARY OF THE DISCLOSURE

One or more embodiments provides a silencer which can be connected to and removed from a firearm's barrel in a simple and safe manner, and which consists of a small number of parts.

One or more embodiments is achieved according to the invention by means of the features indicated in the following description below.

One or more embodiments relates to a silencer for a firearm and an associated attachment element, where the silencer is designed to be able to be releasably connected to the attachment element which is mounted on the barrel of the firearm.

One or more embodiments comprises a substantially cylindrical housing which is provided with an attachment part, an intermediate part and an outer muzzle part, where in the intermediate part a number of elements are arranged which will be capable of suppressing the sound of a report resulting from the firing of the weapon. The silencer is further designed to be releasably connected with an attachment element mounted on the barrel of a firearm, in which case the silencer's attachment part, i.e. the part of the silencer which has to be connected to the attachment element, is provided with a number of cut-outs round its circumference, where each cut-out is composed of a portion extending a distance in the silencer's longitudinal direction and a portion extending a distance over the circumference of the attachment part, which two portions are connected with an intermediate portion. In the portion which extends a distance over the circumference of the attachment part, at least one of the cut-outs is provided with at least one bead, in order thereby to create a narrowing of the portion of the cut-out extending a distance over the circumference of the attachment part, where adjacent to this portion at least one additional slot is provided extending over the circumference of the attachment part. In this embodiment of the silencer, therefore, the cut-outs will be provided passing through the material of the attachment part.

In one or more embodiments the at least one slot which is arranged adjacent to the portion of the cut-out provided with at least one bead will be designed to have the same length as the adjacent portion, in which case the slot will have a width or height which is less than the width of the adjacent portion with the bead. It should be understood, however, that the slot may be designed to have other lengths and/or widths. The slot, moreover, is preferably arranged between the silencer's intermediate part and the portion with the bead, but may also be arranged on an opposite side of the portion with the bead, or on both sides of the portion with the bead.

The slot may furthermore extend parallel to the portion with the bead, and the slot may also be composed of several smaller holes, partial slots etc. arranged one behind the other, where these will have the same function as the slot.

Together with the portion of the cut-out which is provided with at least one bead according to the present invention, the slot will act as a spring element, as the slot and the portion with the bead will be separated by a distance element with relatively little width or height in accordance with the design of the cut-out and the slot, where this distance element will then be permitted to be moved in the silencer's longitudinal direction when by means of the attachment part the silencer has to be connected to an attachment element which is mounted on the firearm's barrel, since the attachment element is provided with a number of locking pins corresponding to the cut-outs with which the silencer's attachment part is provided.

The assembly of the silencer and the attachment element and the function of the distance element will be explained in greater detail below.

The intermediate portion connecting the portion of the cut-out which extends a distance in the silencer's longitudinal direction and the portion of the cut-out which extends a distance over the circumference of the attachment part, in order thereby to form the cut-out, may be provided at least over a part of its length with a straight piece, where this straight piece is arranged so as to form an angle with both the portion of the cut-out which extends a distance in the silencer's longitudinal direction and the portion of the cut-out which extends a distance over the circumference of the attachment part. This design of the cut-out will provide a force which will help to separate the silencer and the attachment element when the silencer has to be released from the attachment element, since on account of the design of the intermediate portion, the locking pins in the attachment element will be forced out of engagement with the portion of the cut-out which extends a distance over the circumference of the attachment part when the silencer is screwed about its longitudinal direction, with the result that the locking pins are inserted in the portion which extends a distance in the silencer's longitudinal direction. In a similar manner the intermediate portion's design will force the locking pins into engagement with the portion of the cut-out which extends a distance over the circumference of the attachment part when the silencer has to be connected to the attachment element which is mounted on the barrel of the firearm.

In one or more embodiments the silencer's attachment part is provided with four cut-outs which are arranged at an equal distance apart, for example located at 90 degrees apart from one another, and where two of these cut-outs are provided with a bead. Adjacent to each of these cut-outs with bead there is also provided a slot extending over the circumference of the attachment part. It should be understood, however, that the attachment part may also be provided with a greater or smaller number of cut-outs, for example three, where the cut-outs may be arranged at an equal or unequal distance relative to one another, and where fewer or all the cut-outs may be provided with a bead. Furthermore it should be understood that several beads may also be provided in this portion. In this embodiment the two other cut-outs will then be provided with an intermediate portion which is provided over at least a part of its length with a straight piece, with the result that these two cut-outs will produce a force which will provide help when silencer and attachment element have to be connected or released.

In one or more embodiments the silencer's attachment part is provided with three cut-outs which are arranged at 120 degrees relative to one another. In this embodiment a cut-out may, for example, be provided with at least one bead, and where adjacent to this cut-out a slot is provided extending over the circumference of the attachment part, while two cut-outs will then be provided with an intermediate portion which is provided over at least a part of its length with a straight piece, with the result that these two cut-outs will produce a force which will provide help when silencer and attachment element have to be connected or released.

The cut-outs have a J or L-shape, but may also have other geometrical shapes which will enable a releasable locking to be achieved between the silencer and the attachment element.

The at least one bead which is provided in the portion of the cut-out extending a distance over the circumference of the attachment part is arranged located outside the portion extending a distance in the silencer's longitudinal direction. The at least one bead will furthermore extend into the portion of the cut-out which extends a distance over the circumference of the attachment part, with the result that the at least one bead will create a narrowing of this portion.

It should be understood that the portion of the cut-out which extends a distance over the circumference of the attachment part may be provided with several beads arranged behind one another, where the bead or beads may have a geometry which results in the need to apply an extra force in order to move the attachment element's locking pins past the bead or beads.

If several beads are provided in the portion of the cut-out which extends a distance over the circumference of the attachment part, the beads may have the same or different geometry and/or dimensions.

When the silencer according to the present invention has to be connected to the attachment element mounted on the firearm's barrel, the silencer will be inserted towards the attachment element's locking pins, so that the locking pins are inserted into the portions of the cut-outs which extend a distance in the silencer's longitudinal direction. When the locking pins have come into contact with the intermediate portion of the cut-out, the silencer will begin to be rotated about its longitudinal axis, whereby this rotation will cause the straight piece in the intermediate portion of the cut-out to force the locking pins into engagement with the portion of the cut-out extending a distance over the circumference of the attachment part. After the locking pins have been inserted a distance into the portion of the cut-out extending a distance in the circumference of the attachment part, at least one of the locking pins will be brought into contact with the at least one bead. By means of a further rotation of the silencer, the locking pin will be brought past the bead, since by means of this rotation the distance element will be deflected in towards the adjacent slot, thereby enabling the locking pin to be moved past the bead. When the locking pin has been moved past the bead, the distance element will assume its original position again, thereby locking the locking pin in the cut-out. By means of this design of the cut-out(s) and slot(s) the distance element will be able to flex in the silencer's longitudinal direction when a locking pin is moved past the bead(s), whereupon the distance element will assume its original position when the locking pin has been moved past the bead(s).

In one or more embodiments the distance element is designed to be able to flex in the silencer's radial direction. The silencer's attachment part will then be provided in a similar manner to that indicated above with a number of cut-outs, slots, etc., but in this case the cut-outs will not be designed to pass through the material of the attachment part. In this alternative embodiment, moreover, at least two slots will be provided adjacent to the portion of the non-through-going cut-out which extends a distance over the circumference of the attachment part, where one of the slots is arranged between the silencer's intermediate part and the portion extending a distance over the circumference of the attachment part, and where the second slot is arranged between the portion extending a distance over the circumference of the attachment part and the attachment part's end termination, with the result that the slots are arranged on each side of the portion extending a distance over the circumference of the attachment part. Near one of the ends of the slots an additional slot is further provided, where this slot will extend over both the slots. Between them, the three slots will therefore form a distance element, which distance element will be flexible in the silencer's radial direction. This distance element will then be provided with at least one bead, where this bead is arranged on the inside of the distance element, extending radially into the silencer, in order thereby to create a radial narrowing of the portion of the cut-out which extends a distance over the circumference of the attachment part.

It will be appreciated that, with the exception of the cut-outs, which are designed not to pass through the material of the attachment part, and the distance element which is designed to provide a radial flexibility, this embodiment of the silencer could otherwise be designed in a similar manner to that indicated with regard to the one or more embodiments of the silencer.

The assembly of the silencer and the attachment element will also be accomplished as explained above with regard to the one or more embodiments of the silencer, except for the fact that the distance element will now be radially flexible.

The present invention also relates to an attachment element for a silencer, where the attachment element is designed to be able to be mounted on the barrel of a firearm. The attachment element comprises a casing element with a flange part which is provided with an outer and inner flange, where the outer flange is arranged to interact with an abutment shoulder in a silencer's attachment part, while the inner flange is arranged to interact with an outer abutment surface in the barrel of a firearm. The outer flange will then be provided with a diameter which is approximately equal to the attachment part's internal diameter, while the inner flange has a diameter which at least is approximately equal to a diameter of the barrel of the firearm, at least over a part of the barrel's length. The attachment element is further provided with a number of locking pins over its circumference, which locking pins are designed to interact with a corresponding number of cut-outs in the silencer's attachment part.

In one or more embodiments of the attachment element the locking pins are designed to have a length which will be flush with an outer diameter of the silencer's attachment part when the silencer is connected with the attachment element. It should be understood, however, that the locking pins may be designed to have other lengths, where the locking pins furthermore may have the same or different length, thickness etc.

The attachment element according to the present invention could be an independent element which is designed to be mounted in a suitable manner on a firearm's barrel, for example by being provided with threads, thereby enabling the attachment element to be screwed on to the firearm's barrel, or the attachment element may be designed to be able to be mounted between the firearm's barrel and a flash eliminator, muzzle brake or the like. The attachment element may also be integrated in the firearm's barrel, flash eliminator, muzzle brake or the like.

Further objects, structural embodiments and advantages of the present invention will be clearly shown in the following detailed description, and the attached drawings.

BRIEF DESCRIPTION OF DRAWINGS

The invention will now be explained with reference to the attached figures in which.

DETAILED DESCRIPTION

In embodiments of the invention, numerous specific details are set forth in order to provide a more thorough understanding of the invention. However, it will be apparent to one with ordinary skill in the art that the invention may be practiced without these specific details. In other instances, well-known features have not been described in detail to avoid obscuring the invention.

Figure 1:
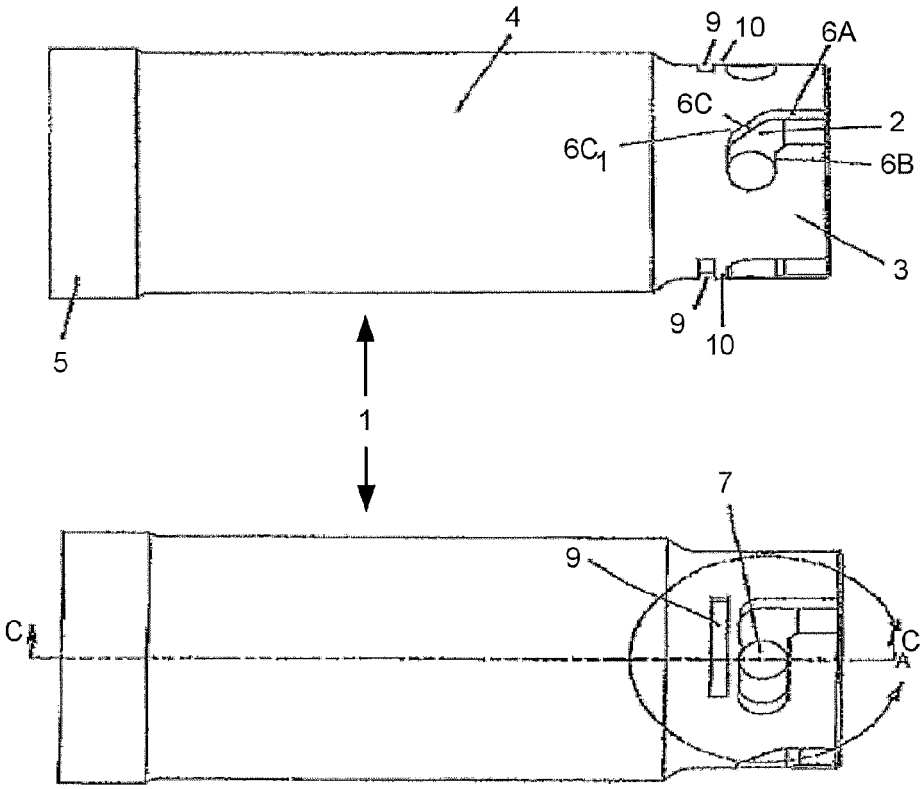
FIG. 1 illustrates an embodiment of a silencer connected to an attachment element according to the present invention.
Figure 2:
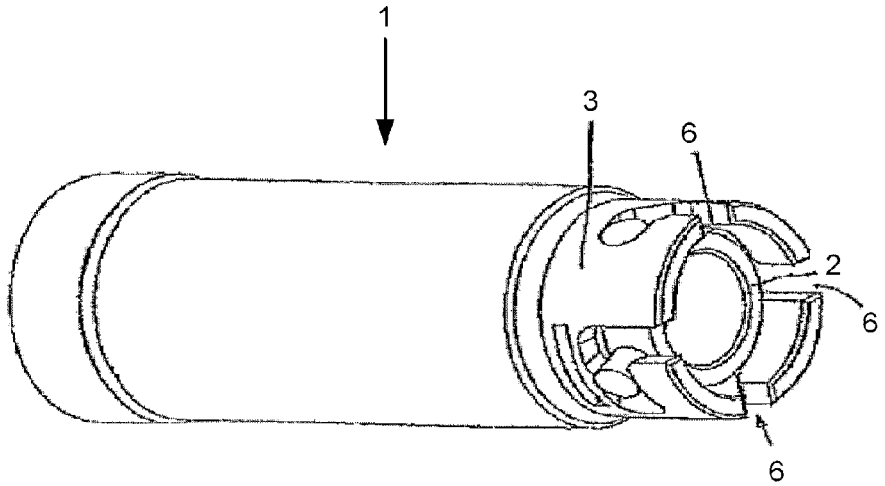
FIG. 2 illustrates the silencer and the attachment element in FIG. 1 partially viewed from the side.

In FIG. 1 a first embodiment is illustrated of a silencer 1 and an attachment element 2 according to the present invention depicted connected to each other, where the silencer 1 comprises an attachment part 3, an intermediate part 4 and an outer muzzle part 5.

In the intermediate part 4 of the silencer a number of elements E are mounted which will be capable of suppressing the sound of a report produced during firing of a weapon (not shown). A person skilled in the art will know what constitutes the elements E and how they should be constructed, and therefore this will not be discussed further here.

Figure 3:
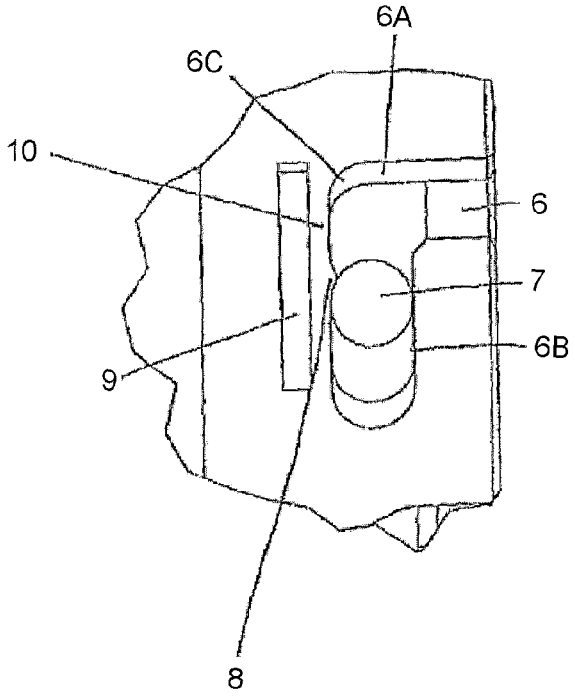
FIG. 3 illustrates in greater detail the design of the silencer's attachment part.
Figure 4:
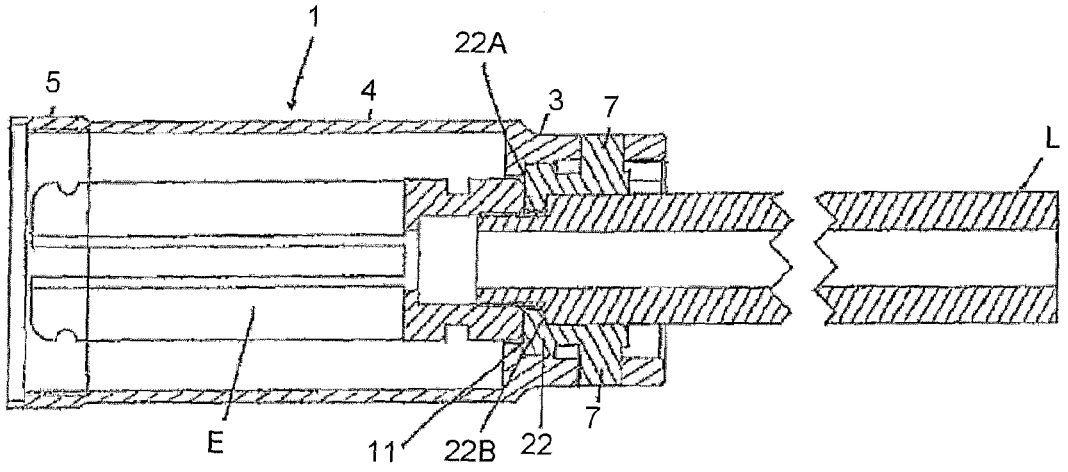
FIG. 4 illustrates a longitudinal cross section of the silencer and the attachment element in FIG. 1.
Figure 5:
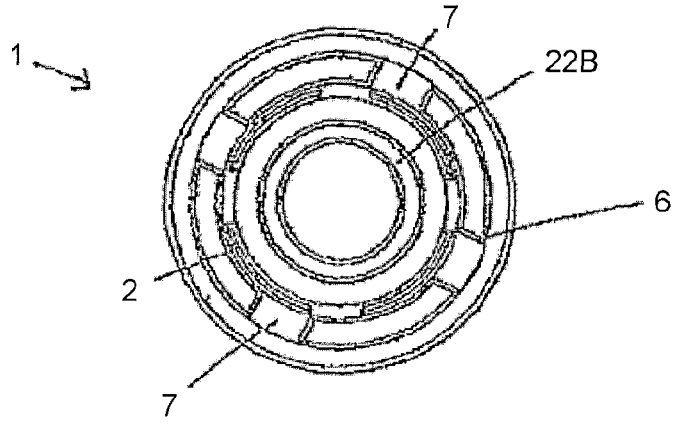
FIG. 5 illustrates the silencer and the attachment element viewed from above.

In the illustrated embodiment the silencer's attachment part 3 is provided with four cut-outs 6, the cut-outs 6 being arranged in twos diametrically above one another. The cut-outs 6 are composed of a portion 6A which extends a distance in the silencer's 1 longitudinal direction and a portion 6B which extends a distance over the circumference of the attachment part 3. The portions 6A, 6B are further connected by an intermediate portion 6C, in order thereby to provide a J-shaped cut-out. At least one cut-out 6 in the attachment part 3, see the lower part of FIG. 1, will be designed to achieve a releasable locking with a locking pin 7 in the attachment element 2. This cut-out 6 will then be provided with a portion 6B which extends a longer distance over the circumference of the attachment part 3 than the other cut-outs 6, see also FIG. 3. In the portion 6B, moreover, a bead 8 is provided, where this bead 8 is arranged in an area of the portion 6B located outside the intermediate portion 6C and the portion 6A of the cut-out 6. The bead 8 will furthermore extend into the portion 6B, so that the bead 8 creates a narrowing of the portion 6B. Below the portion 6B of this cut-out 6, i.e. between the cut-out 6 and the silencer's 1 intermediate part 4, a slot 9 is provided, where the slot 9 extends parallel to the intermediate portion 6C and the portion 6B of the cut-out 6. The slot 9 and the portions 6B, 6C will then be separated by a distance element 10, which is provided with the bead 8, where the portion 6B, the distance element 10 and the slot 9 will interact in order to achieve a releasable connection between the silencer 1 and the attachment element 2. This will be explained in more detail below.

The other cut-outs 6 in the silencer's 1 attachment part 3 will then be designed like the cut-out 6 as illustrated in the upper part of FIG. 1; in a similar manner, the cut-out 6 shown here will comprise a portion 6A extending a distance in the silencer's 1 longitudinal direction and a portion 6B extending a distance over the circumference of the attachment part 3, where the portions 6A, 6B are connected by an intermediate portion 6C, in order thereby to form a J-shaped cut-out. Over a part of its length the intermediate portion 6C is provided with a straight piece $6C_1$, where this straight piece $6C_1$ then forms an angle with both the portions 6A, 6B. This design of the portion $6C_1$ will provide a force which will help to separate silencer 1 and attachment element 2 when the silencer 1 has to be separated from the attachment element 2, since, on account of the straight piece $6C_1$, the locking pins 7 in the attachment element 2 will be forced out of engagement with the portion 6B when the silencer 1 is rotated about its longitudinal direction, with the result that the locking pins 7 are guided into the portion 6A in the cut-out 6. Correspondingly, the straight portion $6C_1$ will force the locking pins 7 into engagement with the portion 6B when the silencer 1 has to be connected to the attachment element 2 mounted on the barrel L of a firearm.

As indicated above the silencer 1 illustrated in FIG. 1 is provided with four cut-outs 6, where two of the cut-outs 6 are provided with a bead 8 and an adjacent slot 9 (shown in the lower part of FIG. 1), while the two remaining cut-outs 6 are provided with the straight piece $6C_1$ in the intermediate portion 6C (shown in the upper part of FIG. 1).

Figure 6:
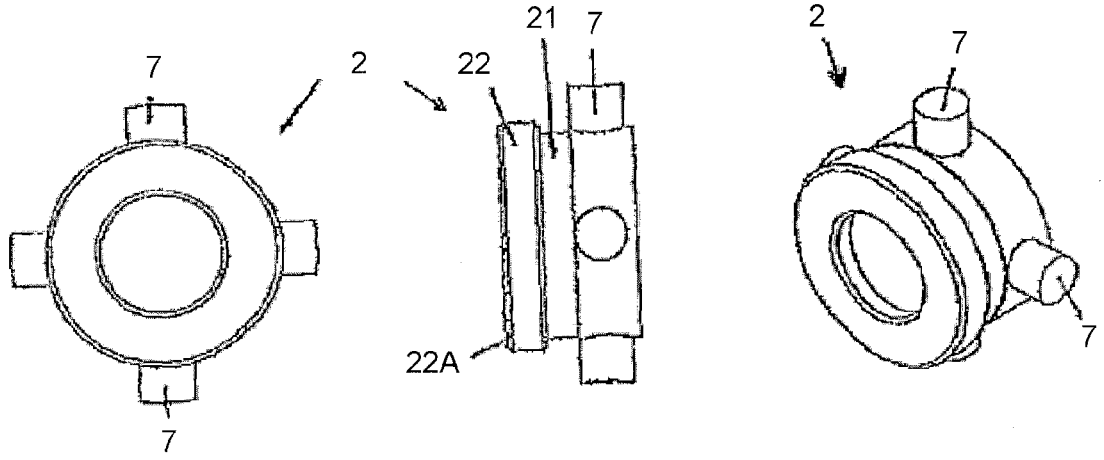
FIG. 6 illustrates the attachment element according to the present invention viewed from above, from the side and partially viewed from the side.

The attachment element 2, see also FIG. 6, according to the present invention is designed to be able to be mounted and/or connected to the barrel L of a firearm, for example by being provided with a threaded portion, or by being designed to be mounted a distance into the barrel's longitudinal direction, between an abutment shoulder on the barrel and a muzzle brake. The attachment element 2 comprises a casing element 21 with a flange part 22 which is provided with an outer flange 22A and an inner flange 22B, where the outer flange 22A is arranged to interact with an abutment shoulder 11 provided internally in the silencer's 1 attachment part 3, while the inner flange 22 is arranged to interact with an outer abutment surface (not shown) in the barrel L of a firearm. The outer flange 22A will then be provided with a diameter which is approximately equal to the attachment part's 3 internal diameter, while the inner flange 22B has a diameter which is at least approximately equal to a diameter of the barrel L of the firearm, at least over a part of the barrel's L length. The attachment element 2 is further provided with a number of locking pins 7 over its circumference, which locking pins 7 are designed to interact with a corresponding number of cut-outs 6 in the silencer's 1 attachment part 3.

When the silencer 1 according to the present invention has to be connected to the attachment element 2 according to the present invention, where the attachment element 2 is mounted on the barrel L of the firearm, the silencer's 1 attachment part 3 will be inserted in towards the attachment element's 2 locking pins 7, so that the locking pins 7 are inserted in portions 6A of the cut-outs 6. When the locking pins 7 have come into contact with the intermediate portion 6C of the cut-outs 6, the silencer 1 will begin to be rotated about its longitudinal axis, whereby this rotation will cause the straight piece $6C_1$ in the intermediate portion 6C of the cut-out 6 to force the locking pins 7 into engagement with the portion 6B of the cut-outs 6. After the locking pins 7 have been inserted a distance into the portions 6B of the cut-outs 6, two of the locking pins 7 will be brought into contact with the beads 8 which are provided in these portions 6B. On further rotation of the silencer 1, the locking pins 7 will be brought past the beads 8, since by means of this rotation the distance elements 10 will be deflected in towards the adjacent slots 9, thereby enabling the locking pins 7 to be moved past the beads 8. When the locking pins 7 have been moved past the beads 8, the distance elements 10 will assume their original position again, whereby the locking pins 7 are locked in the cut-outs 6. By means of this design of the cut-out(s) 6 and slot(s) 9, the distance element 10 will be able to flex in the silencer's 1 longitudinal direction when a locking pin 7 is moved past the bead(s) 8, whereupon the distance element 10 will assume its original position when the locking pins 7 are moved past the bead(s) 8.

Figure 7:
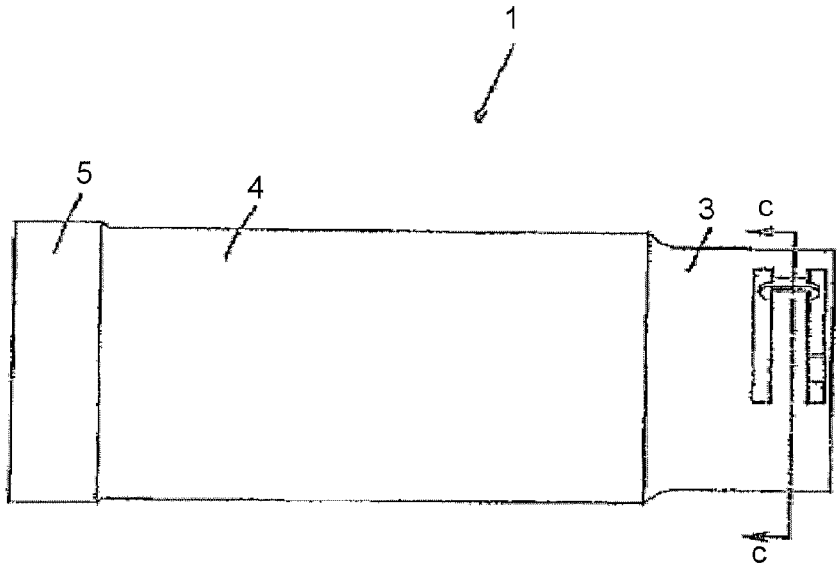
FIG. 7 illustrates a second embodiment of a silencer connected with an attachment element according to the present invention.
Figure 8:
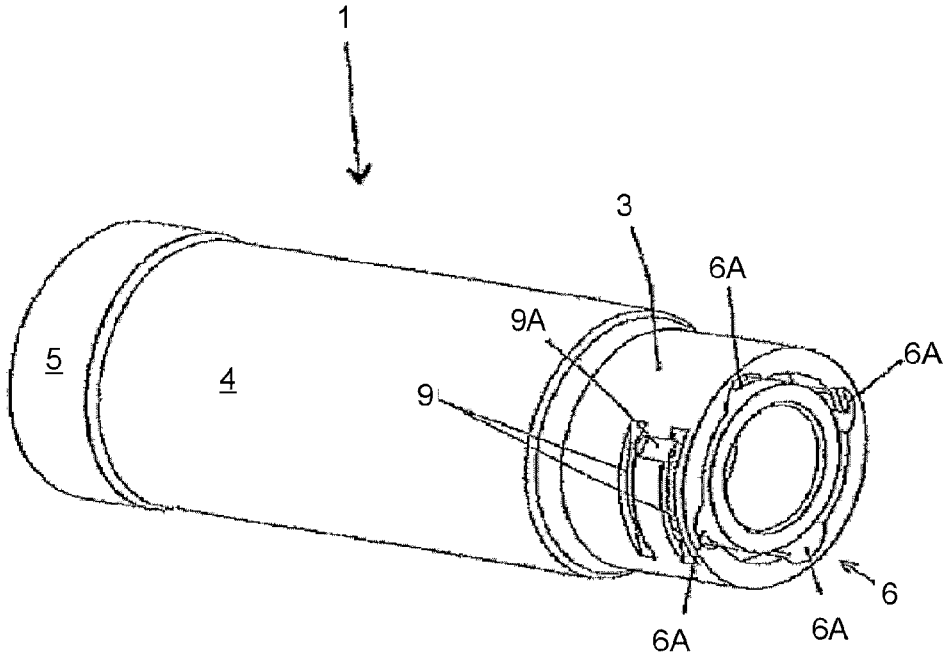
FIG. 8 illustrates the silencer and the attachment element in FIG. 7 partially viewed from the side.

In FIGS. 7 and 8 a second embodiment is illustrated of a silencer 1 and an attachment element 2 according to the present invention, where the silencer 1 and the attachment element 2 are interconnected. The silencer 1 comprises an attachment part 3, an intermediate part 4 and an outer muzzle part 5.

The attachment part 3 comprises four cut-outs 6, where the cut-outs 6 are arranged in twos diametrically above one another. The cut-outs 6 furthermore do not pass through the material of the attachment part 3. The cut-outs 6 are composed of a portion 6A extending a distance in the silencer's 1 longitudinal direction and a portion 6B extending a distance over the inner circumference of the attachment part 3. The portions 6A, 6B are further connected by an intermediate part 6C, in order thereby to provide a J-shaped cut-out. At least one of the cut-outs 6 in the attachment part 3 will then be designed to achieve a releasable locking with a locking pin 7 in the attachment element 2. In connection with this cut-out 6, below the cut-out 6, i.e. between the cut-out 6 and the silencer's 1 intermediate part 4, a slot 9 is provided which is designed to pass through the material of the attachment part 3. In a similar manner an additional slot 9 is provided above the cut-out 6, i.e. between the cut-out 6 and the attachment part's 3 end termination, where this slot 10 too is designed to pass through the material of the attachment part 3. The slots 9 are furthermore arranged adjacent to the portion 6B and extending parallel thereto.

Yet another slot 9A is provided passing through the material of the attachment part 3, near one of the ends of the slots 9, where this slot 9A will extend from one slot 9 to the other slot 9A. The slots 9, 9A will thus define a distance element 10, which distance element 10 will be flexible in the silencer's 1 radial direction. The distance element 10 will furthermore be provided with at least one bead 8, see also FIG. 9, where this bead 8 is arranged on the inside of the distance element 10, extending radially into the silencer's 1 attachment part 3. The placing of the at least one bead 8 in the distance element 10 will create a radial narrowing of the portion 6B of the cut-out 6 which extends a distance over the inner circumference of the attachment part 3.

The other cut-outs 6 will then be provided without the slots 9, 9A and the bead 8.

The releasable connection of the silencer 1 and the attachment element 2, and the function of the distance element 10 will be explained in more detail below.

Figure 9:
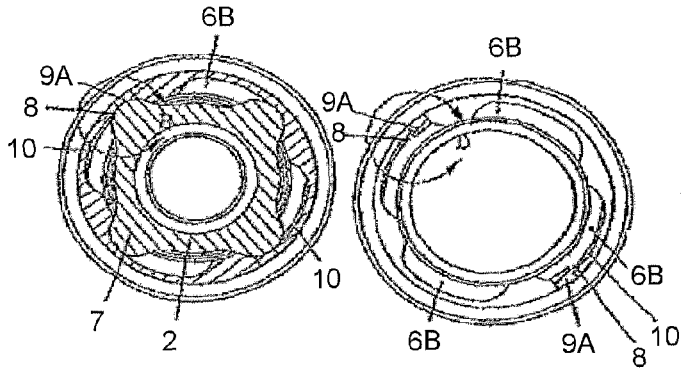
FIG. 9 illustrates a cross section from above, where the cross section is shown both with and without the attachment element.

In FIG. 9 an attachment element 2 according to the present invention is illustrated, where the attachment element 2 is intended to be capable of being releasably connected to a silencer 1 according to the present invention. FIG. 9 illustrates a cross section (viewed from above) of the line C-C in FIG. 1, where the cross section of the attachment part 3 is depicted with and without the attachment element 2. Here it can be seen that the attachment part 3 is provided with four cut-outs 6, where only the portion 6B of the cut-outs 6 extending a distance over the inner circumference of the attachment part 3 is shown. It is further illustrated in the figure that in connection with two of the portions 6B a slot 9A is provided, where these two portions 6B are located arranged diametrically above each other. The distance element 10 will be provided with a bead 8, where this bead 8 is arranged near the slot 9A. When an attachment element 2, which in the illustrated embodiment comprises four locking pins 7, has to be connected to the silencer's 1 attachment part 3, the attachment element 2 will be arranged as illustrated on the left side of the figure (the locking pins 7 will then be mounted on the far right in the cut-outs 6). The silencer 1 will then be rotated clockwise, thereby bringing two of the locking pins 7 into contact with the beads 8 provided in the distance element 10. Since the beads 8 extend inwards in the radial direction of the attachment part 3, they will create a narrowing of the portion 6B of the cut-out 6, and an extra force must be exerted in order to rotate the silencer 1 past the locking pins 7. This extra force will cause the distance element 10 to be deflected slightly away and outwards from the silencer's 1 attachment part 3, thereby enabling the locking pins 7 to be moved past the beads 8. After the locking pins 7 have been moved past the beads 8, the distance element 10 will assume its original position, whereby the locking pins are locked in the portion 6B. By means of this design of the cut-outs 6, the slots 9, 9A and the beads 8, the distance element 10 will be able to flex in the attachment part's 3 radial direction when a locking pin 7 is moved past the bead 8, whereupon the distance element 10 will be able to assume its original position when the locking pin 7 is moved past the bead 8. An opposite procedure is employed when the silencer 1 has to be released from the attachment element 2.

Figure 10:
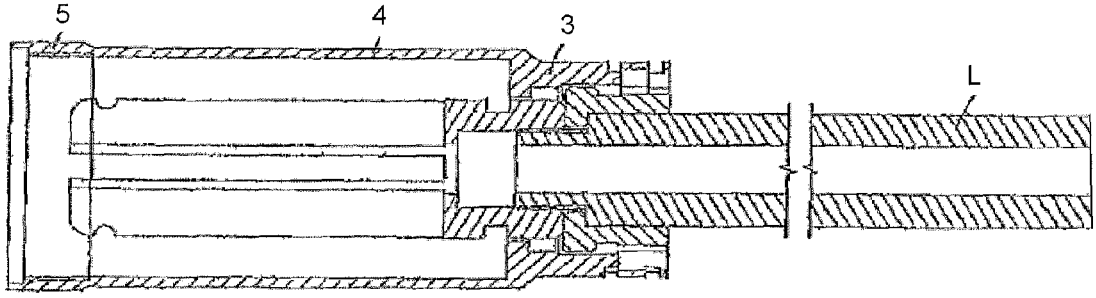
FIG. 10 illustrates a longitudinal cross section of the silencer and the attachment element in FIG. 7.
Figure 11:
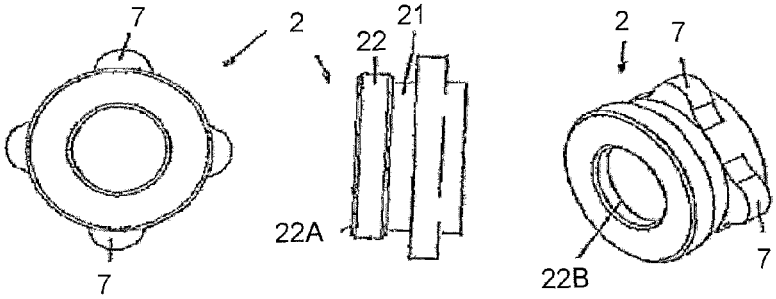
FIG. 11 illustrates the attachment element according to the present invention viewed from above, from the side and partially viewed from the side.

In FIG. 10 the attachment element 2 according to the present invention is illustrated, where the attachment element 2 is designed to be capable of being mounted and/or connected to the barrel L of a firearm, for example by being provided with a threaded portion, or by being designed to be mounted a distance into the barrel's longitudinal direction, between an abutment shoulder on the barrel and a muzzle brake. The attachment element 2 comprises a casing element 21 with a flange part 22 which is provided with an outer flange 22A and an inner flange 22B, where the outer flange 22A is arranged to interact with an abutment shoulder 11 provided internally in the silencer's 1 attachment part 3, while the inner flange 22 is arranged to interact with an outer abutment surface (not shown) in the barrel L of a firearm. The outer flange 22A will then be provided with a diameter which is approximately equal to the attachment part's 3 internal diameter, while the inner flange 22B has a diameter which at least is approximately equal to a diameter of the barrel L of the firearm, at least over a part of the barrel's L length. The attachment element 2 is further provided with a number of locking pins 7 over its circumference, which locking pins 7 are designed to interact with a corresponding number of cut-outs 6 in the silencer's 1 attachment part 3.

The present invention has now been explained with reference to embodiments, but a person skilled in the art will appreciate that changes and modifications will be able to be made to these embodiments which lie within the scope of the invention as defined in the following claims.

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

The invention claimed is:

1. A silencer for a firearm comprising:

a substantially cylindrical external housing comprising:

an attachment part;

an intermediate part comprising a number of elements; and an outer muzzle part, wherein the silencer is configured to be releasably connected to a barrel of a firearm, wherein the attachment part is provided with a plurality of cut-outs disposed around a circumference of the attachment part, wherein each of the plurality of cut-outs comprises a first portion extending a distance in a longitudinal direction with respect to the silencer and a second portion extending a distance over the circumference of the attachment part, wherein the first and second portions are connected with an intermediate portion, wherein at least one of the plurality of cut-outs in the second portion is narrowed by at least one of a plurality of beads, and wherein an adjacent portion with at least one slot is provided extending over the circumference of the attachment part and is adjacent to the second portion.

2. The silencer according to claim 1, wherein the at least one slot and the adjacent portion with the at least one of a plurality of beads have the same length.

3. The silencer according to claim 2, wherein the at least one slot has a width which is less than the width of the adjacent portion with the at least one of a plurality of beads.

4. The silencer according to claim 1, wherein, in at least one of the plurality of cut-outs, the intermediate portion is at least over a part of the length of the intermediate portion provided with a straight piece, forming an angle with the first portion and the second portion.

5. The silencer according to claim 1, wherein the bead in the second portion is arranged on an outside the first portion.

6. The silencer according to claim 1, wherein the attachment part is provided on an inside with an abutment shoulder, wherein the abutment shoulder is arranged below the at least one slot.

7. The silencer according to claim 1, wherein the second portion at an end opposite the intermediate portion is in a form of a semicircle.

8. The silencer according to claim 1, wherein the attachment part is provided on the inside with a plurality of grooves, wherein the plurality of grooves are arranged adjacent to and on each side of the second portion.

9. The silencer according to claim 1, wherein the at least one of a plurality of beads (8) faces into the second portion, thereby creating a narrowing in the second portion of the at least one of the plurality of cut-outs.

10. The silencer according to claim 1, wherein the second portion is provided with a plurality of beads.

11. An attachment element for a silencer comprising:

a casing element comprising:

a flange part provided with an outer and inner flange, wherein the outer flange is arranged to interact with an internal abutment shoulder in an attachment part of the silencer, wherein the inner flange is arranged to interact with an external abutment surface in a barrel of a firearm, wherein the outer flange has a diameter approximately equal to an internal diameter of the attachment part, and wherein the inner flange has a diameter at least approximately equal to a part of an outer diameter of the barrel of the firearm, wherein the attachment element is further provided with a plurality of locking pins over a circumference of the attachment element, and wherein the plurality of locking pins are configured to interact with a plurality of cut-outs provided in the attachment part of the silencer.

12. The attachment element according to claim 11, wherein the plurality of locking pins are level with an external diameter of the attachment part when the silencer is connected to the attachment element.

13. The attachment element according to claim 11, wherein, when rotating the silencer, the plurality of locking pins are arranged to be brought into contact with a plurality of grooves provided on an inside of the attachment part.

* * * * *